US011428383B1

(12) United States Patent
Zheng et al.

(10) Patent No.: US 11,428,383 B1
(45) Date of Patent: Aug. 30, 2022

(54) LIGHT PROJECTOR

(71) Applicant: Shenzhen Bolong Technology Co. Ltd., Shenzhen (CN)

(72) Inventors: Huazhu Zheng, Shenzhen (CN); Yunyun Lu, Shenzhen (CN); Caijian Zheng, Shenzhen (CN); Wenzhen Ouyang, Shenzhen (CN)

( * ) Notice: Subject to any disclaimer, the term of this patent is extended or adjusted under 35 U.S.C. 154(b) by 0 days.

(21) Appl. No.: 17/537,452

(22) Filed: Nov. 29, 2021

(30) Foreign Application Priority Data

Oct. 29, 2021 (CN) ..... 202122656162.9

(51) Int. Cl.

| | |
|---|---|
| ***F21V 5/02*** | (2006.01) |
| ***F21V 15/01*** | (2006.01) |
| ***F21V 23/00*** | (2015.01) |
| ***F21V 29/70*** | (2015.01) |

(52) U.S. Cl.
CPC ..... *F21V 5/02* (2013.01); *F21V 15/01* (2013.01); *F21V 23/003* (2013.01); *F21V 29/70* (2015.01)

(58) Field of Classification Search
CPC ... G03B 21/2013; G03B 21/2033; F21V 5/02; F21V 15/01; F21V 23/003; F21V 29/70
See application file for complete search history.

(56) References Cited

U.S. PATENT DOCUMENTS

| | | | | |
|---|---|---|---|---|
| 6,481,869 | B1 * | 11/2002 | Horandel | F21V 14/045 362/205 |
| 9,068,726 | B2 | 6/2015 | Zhang | |
| 9,395,608 | B2 | 7/2016 | Zhang | |
| 10,234,118 | B2 | 3/2019 | Zhang et al. | |
| 11,118,753 | B1 * | 9/2021 | Zheng | F21S 10/00 |
| 11,221,117 | B1 * | 1/2022 | Xu | F21S 10/063 |
| 2003/0161146 | A1 * | 8/2003 | Sharrah | F21L 4/027 362/183 |
| 2015/0276178 | A1 * | 10/2015 | Chien | G03B 21/001 362/95 |
| 2017/0219176 | A1 * | 8/2017 | Chang | A63J 5/025 |
| 2019/0376653 | A1 * | 12/2019 | Dussaume | F21K 9/69 |

* cited by examiner

*Primary Examiner* — Tsion Tumebo

(57) ABSTRACT

Disclosed is a light projector. The light projector includes a housing, a support mechanism, an optical lens, a light-emitting assembly, and a drive device. The light-emitting assembly includes a water ripple optic, a control board, at least one incoherent light source, and at least one coherent light source. One side of the water ripple optic is arranged facing the optical lens, and the control board is arranged on the other side of the water ripple optic. The control board is provided with a first through-hole and a second through-hole. The drive device passes through the first through-hole and is connected to the water ripple optic to drive the water ripple optic to rotate. The coherent light source is arranged in the second through-hole, and the incoherent light source is arranged on one side of the control board facing the water ripple optic, which effectively increases diversity of lighting effects.

9 Claims, 5 Drawing Sheets

LIGHT PROJECTOR

CROSS REFERENCE TO RELATED APPLICATION

This application claims priority benefit of Chinese Patent Application No. 202122656162.9, filed on Oct. 29, 2021, and the entire contents of which are incorporated herein by reference.

TECHNICAL FIELD

The present invention relates to the field of projector equipment, and in particular to a light projector.

BACKGROUND

Nowadays, light projectors have more and more extensive market applications, and are used in more and more places. For example, in some cases, it is necessary to direct light to buildings to produce lighting effects, which can add an aesthetic effect and atmosphere to the buildings. However, most light projectors in the market currently have only one single illuminating light or one single projection pattern, and the lighting effects of the light projectors are thus relatively monotonous and boring.

In view of this, it is necessary to modify the light projectors to increase the diversity of lighting effects of the light projectors.

SUMMARY

The main objective of the present invention is to propose a light projector, which is intended to increase the diversity of lighting effects of the existing light projectors.

In order to achieve the above objective, a light projector proposed by the present invention includes: a housing, a support mechanism, an optical lens, a light-emitting assembly, and a drive device, where a front end of the housing is provided with a mounting hole, the optical lens is arranged in the mounting hole, and the support mechanism is arranged at a lower part of the housing for supporting the housing;

the light-emitting assembly and the drive device are arranged in the housing; the light-emitting assembly includes a water ripple optic, a control board, at least one incoherent light source, and at least one coherent light source; one side of the water ripple optic is arranged facing the optical lens, and the control board is arranged on the other side of the water ripple optic; the control board is provided with a first through-hole and a second through-hole; the drive device passes through the first through-hole and is connected to the water ripple optic to drive the water ripple optic to rotate; and the coherent light source is arranged in the second through-hole, and the incoherent light source is arranged on one side of the control board facing the water ripple optic.

Optionally, the light-emitting assembly further includes a cover, where the cover is provided over the incoherent light source and the coherent light source and is fixed to the control board, and a fixing ring for fixing the coherent light source is arranged on the cover.

Optionally, the light-emitting assembly further includes a heat sink arranged on a periphery of the coherent light source.

Optionally, one face of the water ripple optic that is arranged facing the optical lens is shaped to simulate irregular and uneven water ripples.

Optionally, the optical lens has a semi-spherical outline, an outer spherical surface of the optical lens is a smooth surface without texture, and an inner spherical surface of the optical lens is composed of a plurality of polyhedral pyramid prisms connected to each other.

Optionally, the housing includes a front housing and a rear housing snap-fitted with the front housing, a first sealing ring is arranged at the joint of the front housing and the rear housing, the mounting hole is provided in the front housing, and the rear housing is provided with a first line passage hole for allowing a power line to pass through.

Optionally, the light projector further includes a seal, where the rear housing is recessed to form a sealing groove, the first line passage hole is provided in a groove bottom of the sealing groove, a groove wall of the sealing groove is provided with an internal thread, the seal is in threaded connection with the sealing groove, and the seal is further provided with a second line passage hole for allowing the power line to pass through.

Optionally, a second sealing ring is arranged between the seal and the groove bottom of the sealing groove.

Optionally, the support mechanism includes a sleeve rotatably arranged on the housing and a ground stake with one end inserted into the sleeve.

Optionally, the support mechanism includes a sleeve rotatably arranged on the housing and a mount base with one end inserted into the sleeve and the other end fixed to the ground.

According to the technical schemes of the present invention, the optical lens is arranged in the mounting hole at the front end of the housing for refracting light rays emitted by the light-emitting assembly, the support mechanism is arranged at the lower part of the housing for supporting the housing, and the light-emitting assembly and the drive device are arranged in the housing. The light-emitting assembly emits the light rays toward the optical lens. The light-emitting assembly includes a water ripple optic, a control board, an incoherent light source and a coherent light source. The water ripple optic is used for changing the lighting effects of the light sources. Specifically, the incoherent light source and the coherent light source are arranged on the same side of the water ripple optic, light rays from the incoherent light source are refracted by the water ripple optic to form a lighting effect similar to water ripples, and light rays from the coherent light source are refracted by the water ripple optic to form a lighting effect similar to the northern lights. The control board is electrically connected to the drive device, the incoherent light source and the coherent light source to control the rotation speed of the drive device and the switching of the light sources. Moreover, the drive device passes through the first through-hole and is connected to the water ripple optic to drive the water ripple optic to rotate, so that the two lighting effects are in an active state, thereby effectively increasing the diversity of lighting effects of the light projector.

BRIEF DESCRIPTION OF DRAWINGS

In order to illustrate more clearly embodiments of the present invention or technical schemes in the related art, the drawings used in description of the embodiments or the related art will be briefly described below, and obviously, the drawings in the following description are only some embodiments of the present invention, and for those of ordinary skill in the art, other drawings can be derived on the basis of the structures shown in these drawings without any inventive effort.

Figure 1:
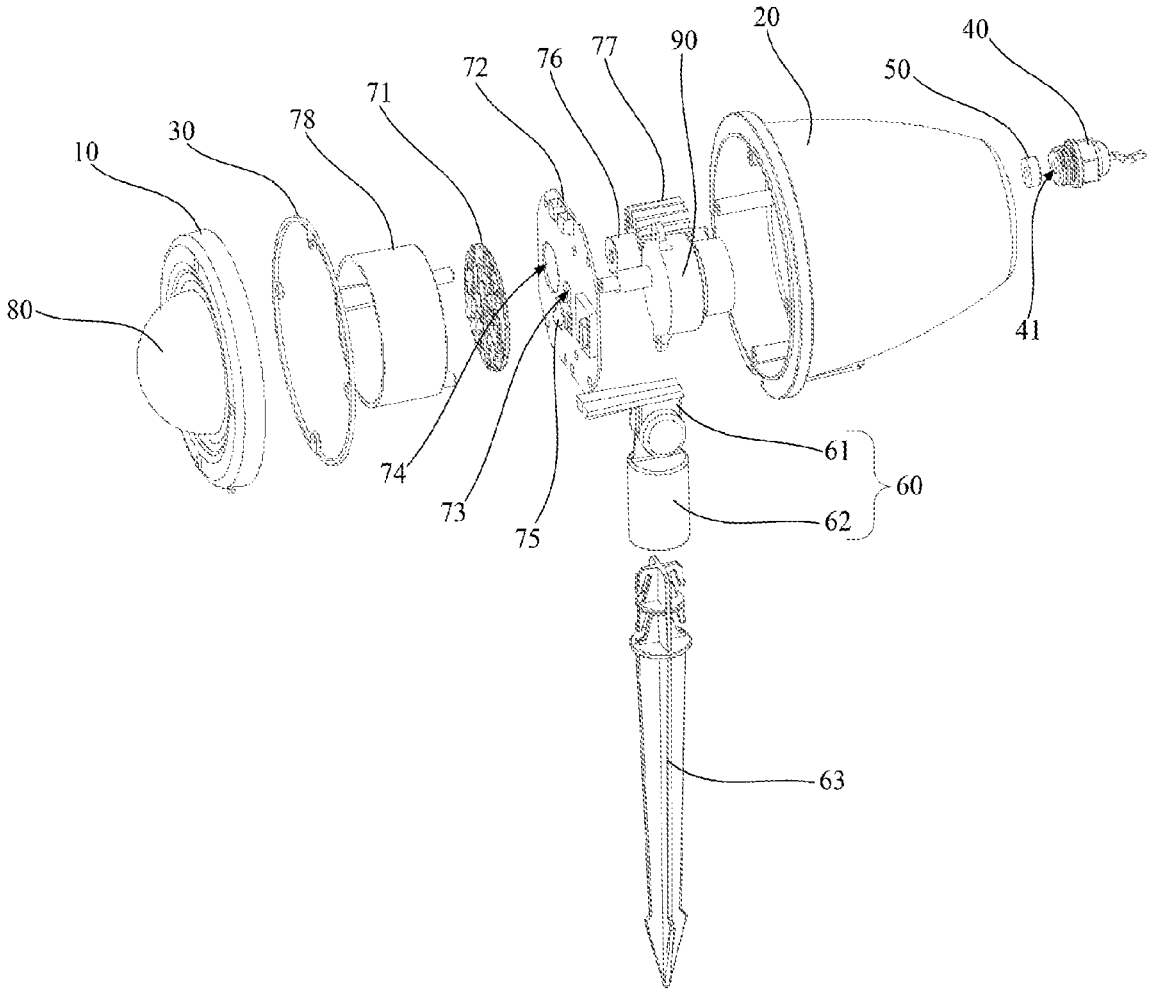
FIG. 1 is a schematic exploded view of the structure of an embodiment of a light projector of the present invention.

Description of reference numerals:

| Reference numeral | Name | Reference numeral | Name |
|---|---|---|---|
| 10 | Front housing | 71 | Water ripple optic |
| 20 | Rear housing | 72 | Control board |
| 21 | First line passage hole | 73 | First through-hole |
| 22 | Sealing groove | 74 | Second through-hole |
| 30 | First sealing ring | 75 | Incoherent light source |
| 40 | Seal | 76 | Coherent light source |
| 41 | Second line passage hole | 77 | Heat sink |
| 50 | Second sealing ring | 78 | Cover |
| 60 | Sleeve | 79 | Fixing ring |
| 61 | Connection member | 80 | Optical lens |
| 62 | Sleeve body | 90 | Drive device |
| 63 | Ground stake | 64 | Mount base |

The achievement of the purpose, functional features and advantages of the present invention will be further illustrated in combination with the embodiments and with reference to the accompanying drawings.

DETAILED DESCRIPTION

The technical schemes in the embodiments of the present invention are clearly and completely described in the following with reference to the accompanying drawings in the embodiments of the present invention. It is obvious that the described embodiments are only some of the embodiments of the present invention instead of all the embodiments. All other embodiments obtained by those of ordinary skill in the art based on the embodiments of the present invention without inventive effort are within the scope of the present invention.

It should be noted that if there is a directional indication (such as up, down, left, right, front, back, . . . ) in the embodiments of the present invention, the directional indication is only used to explain the relative positional relationship, movement condition, etc. between components in a specific orientation (as shown in the accompanying drawings). If the specific orientation changes, the directional indication will change accordingly.

In addition, if there are descriptions of "first", "second", etc. in the embodiment of the present invention, the descriptions of "first", "second", etc. are only used for descriptive purposes, and cannot be understood as indicating or implying their relative importance or implicitly indicating the number of technical features indicated. Therefore, the features defined with "first" and "second" may explicitly or implicitly include at least one of the features. In addition, the term "and/or" appearing herein means that three parallel schemes are included. Taking "A and/or B" as an example, scheme A, scheme B, or both A and B schemes are included. In addition, the technical schemes of various embodiments can be combined with each other, but it must be based on what can be achieved by those of ordinary skill in this field. When the combination of technical schemes is contradictory or cannot be achieved, it should be considered that such a combination of technical schemes does not exist and is not within the scope of protection required by the present invention.

The present invention provides a light projector.

In an embodiment of the present invention, as shown in FIGS. 1 to 5, the light projector includes: a housing, a support mechanism, an optical lens 80, a light-emitting assembly, and a drive device 90.

A front end of the housing is provided with a mounting hole, the optical lens 80 is arranged in the mounting hole, and the support mechanism is arranged at a lower part of the housing for supporting the housing.

The light-emitting assembly and the drive device 90 are arranged in the housing. The light-emitting assembly includes a water ripple optic 71, a control board 72, at least one incoherent light source 75, and at least one coherent light source 76. One side of the water ripple optic 71 is arranged facing the optical lens 80, and the control board 72 is arranged on the other side of the water ripple optic 71. The control board 72 is provided with a first through-hole 73 and a second through-hole 74. The drive device 90 passes through the first through-hole 73 and is connected to the water ripple optic 71 to drive the water ripple optic 71 to rotate. The coherent light source 76 is arranged in the second through-hole 74, and the incoherent light source 75 is arranged on one side of the control board 72 facing the water ripple optic 71.

It should be explained that the housing is the shell of light projector, which is internally provided with a mounting cavity for providing a mounting position for another component of the light projector and protecting another component of the light projector from external forces. The support mechanism is arranged at the lower part of the housing and used for supporting the housing so that the light projector can adapt to more application scenarios. The support mechanism may be detachably or fixedly connected to the housing, which is not specifically limited here. The front end of the housing is provided with a mounting hole, and the optical lens 80 is arranged in the mounting hole, and is used for refracting and enlarging the light rays emitted by the light-emitting assembly before emitting the light rays, so as to increase the illumination range of the light. Specifically, the optical lens 80 has a semi-spherical outline, an outer spherical surface of the optical lens is a smooth surface without texture, and an inner spherical surface thereof is composed of a plurality of polyhedral pyramid prisms connected to each other, so that when the light rays pass through the inner spherical surface of the optical lens 80, the polygonal pyramid prisms refract the light rays, thereby increasing the illumination range of the light.

The light-emitting assembly and the drive device 90 are arranged in the housing, and the light-emitting assembly, as a light-emitting device of the light projector, is used for projecting lights similar to the water ripple effect and with the effect of northern lights. Specifically, the light-emitting assembly includes a water ripple optic 71, a control board 72, at least one incoherent light source 75 and at least one coherent light source 76. One face of the water ripple optic 71 that faces the optical lens 80 is shaped to have irregular water ripples. The incoherent light source 75 and the coherent light source 76 are arranged on the same side of the water ripple optic 71. When the incoherent light source 75 irradiates the water ripple optic 71, the light rays refracted by the water ripple optic 71 have a lighting effect similar to water ripples on the projection plane. At the same time, when the coherent light source 76 irradiates the water ripple optic 71, the light rays from the coherent light source 76 that are refracted by the water ripple optic 71 have a lighting effect similar to the northern lights on the projection plane. It should be explained that the incoherent light source 75 may be an LED light source, a superluminescent diode or a broadband light source, the coherent light source 76 may be a monochromatic laser, and a plurality of incoherent light sources 75 and coherent light sources 76 may be provided, which is specifically subject to the size of the actual application scene, and is not limited here.

The water ripple optic 71 is rotatably arranged on the drive device 90. It can be understood that the drive device 90 drives the water ripple optic 71 to rotate, so that the two lighting effects are in an active state, and the lighting effects of active water ripples and the active northern lights are thus formed, so that the diversity of lighting effects of the light projector can be effectively increased, and the user experience can be improved. The drive device 90 may be an electric motor or an air cylinder, which is not specifically limited here.

In addition, the control board 72 is electrically connected to the drive device 90, the incoherent light source 75 and the coherent light source 76 to control the rotation speed of the drive device 90 and the switching of the light sources.

According to the technical schemes of the present invention, the optical lens 80 is arranged in the mounting hole at the front end of the housing for refracting light rays emitted by the light-emitting assembly, the support mechanism is arranged at the lower part of the housing for supporting the housing, and the light-emitting assembly and the drive device 90 are arranged in the housing. The light-emitting assembly emits the light rays toward the optical lens 80. The light-emitting assembly includes a water ripple optic 71, a control board 72, an incoherent light source 75 and a coherent light source 76. The water ripple optic 71 is used for changing the lighting effects of the light sources. Specifically, the incoherent light source 75 and the coherent light source 76 are arranged on the same side of the water ripple optic 71, light rays from the incoherent light source 75 are refracted by the water ripple optic 71 to form a lighting effect similar to water ripples, and light rays from the coherent light source 76 are refracted by the water ripple optic 71 to form a lighting effect similar to the northern lights. The control board 72 is electrically connected to the drive device 90, the incoherent light source 75 and the coherent light source 76 to control the rotation speed of the drive device 90 and the switching of the light sources. Moreover, the drive device 90 passes through the first through-hole 73 and is connected to the water ripple optic 71 to drive the water ripple optic 71 to rotate, so that the two lighting effects are in an active state, thereby effectively increasing the diversity of lighting effects of the light projector.

Figure 2:
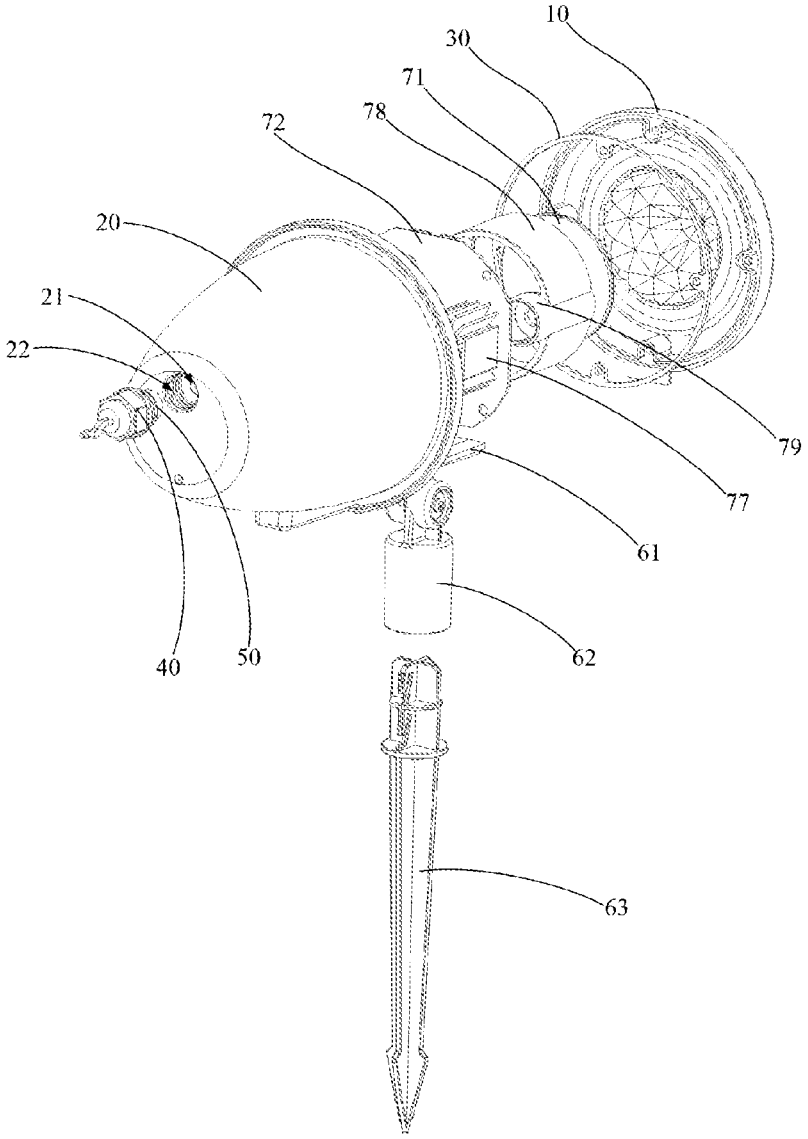
FIG. 2 is a schematic exploded view of the structure of the embodiment of the light projector of the present invention from another perspective.

Further, as shown in FIGS. 1 and 2, the light-emitting assembly further includes a cover 78. The cover 78 is provided over the incoherent light source 75 and the coherent light source 76 and is fixed to the control board 72. A fixing ring 79 for fixing the coherent light source 76 is arranged on the cover 78. In this embodiment, the cover 78 is used for gathering the light rays from the incoherent light source 75 and the coherent light source 76, so as to effectively increase the luminous intensity of the light-emitting assembly. Specifically, the cover 78 is of an annular structure having two open ends, with one open end provided over the incoherent light source 75 and the coherent light source 76 and fixed to the control board 72, and the other end provided with the water ripple optic 71, such that the light rays emitted by the incoherent light source 75 and the coherent light source 76 can effectively pass through the water ripple optic 71 for refraction, thereby increasing the luminous intensity of the light-emitting assembly.

The fixing ring 79 is used for providing a mounting position for the coherent light source 76, so as to prevent the coherent light source 76 from being displaced due to an external force affecting the effective irradiation of the coherent light source 76 on the water ripple optic 71, so that the practicability of the light projector can be effectively improved.

The fixing ring 79 and the cover 78 are integrally formed.

Figure 4:
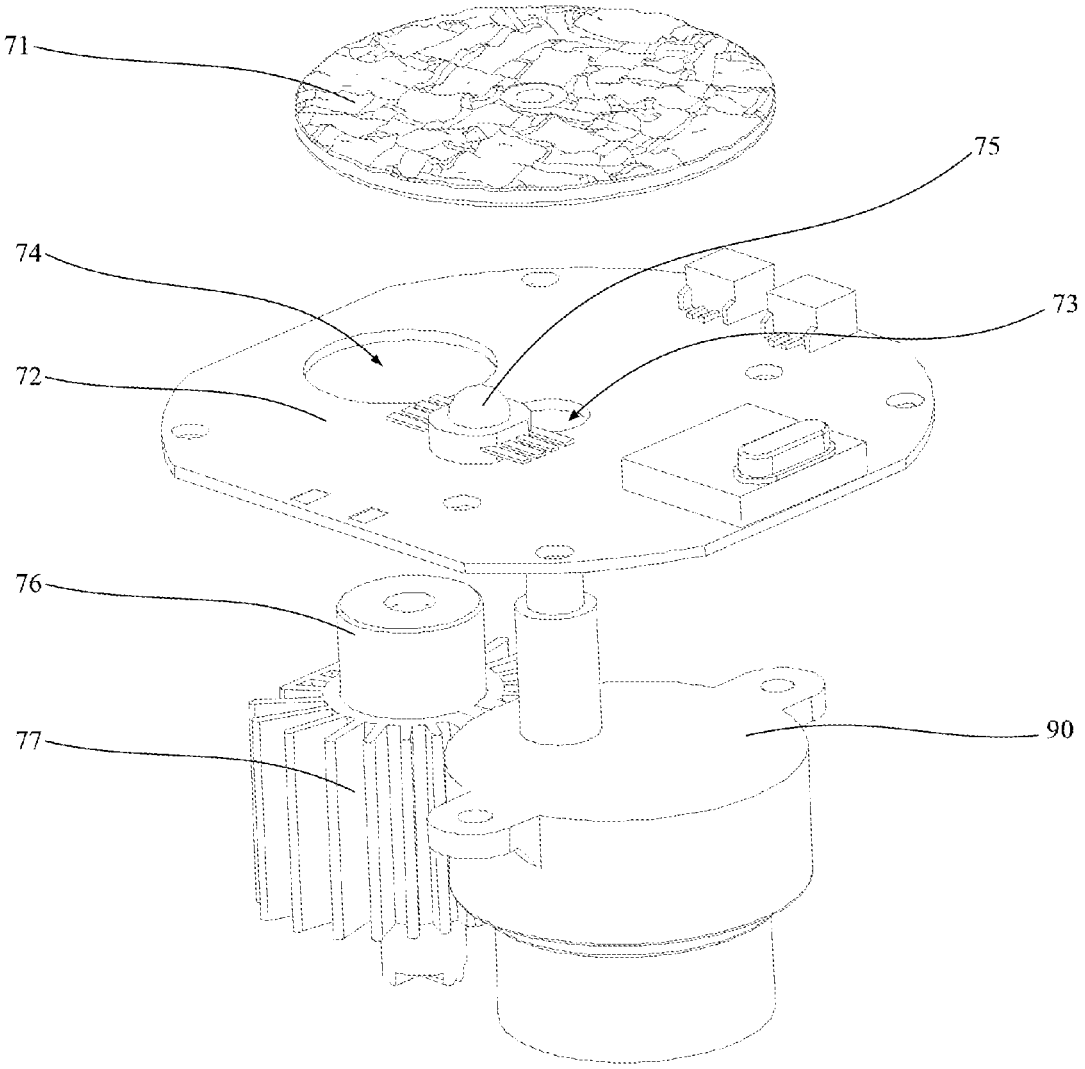
FIG. 4 is a schematic exploded view of a structure of a light-emitting assembly.
Figure 5:
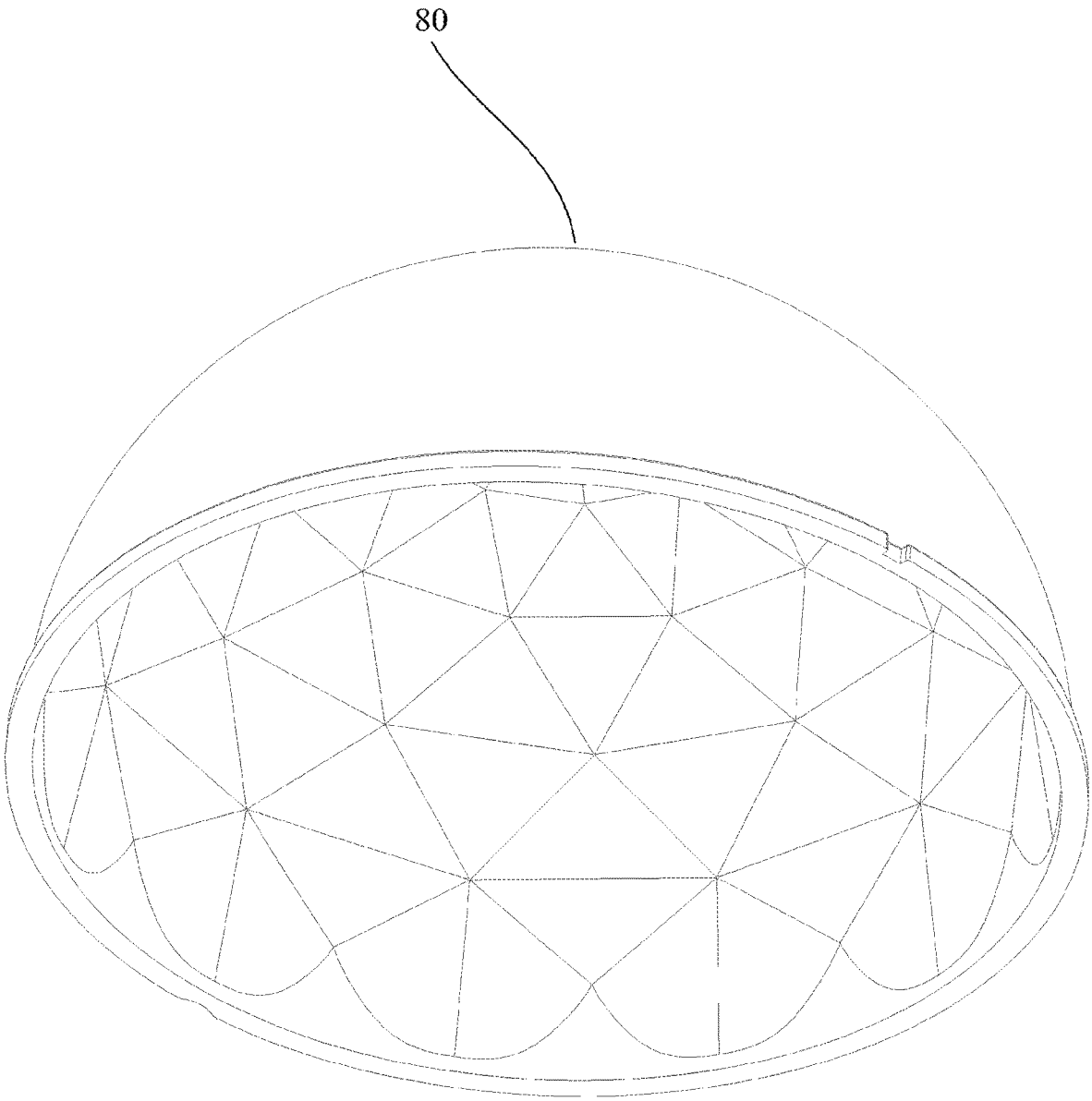
FIG. 5 is a schematic view of the structure of an optical lens.

Further, as shown in FIGS. 1, 2 and 4, the light-emitting assembly further includes a heat sink 77 arranged on a periphery of the coherent light source 76. In this embodiment, because of the unique luminous performance of coherent light source 76, the coherent light source 76 will generate more heat energy when emitting light than the incoherent light source. If the heat energy is not dissipated in a timely manner, the service life of the coherent light source 76 will be affected. Therefore, in this embodiment, a heat sink 77 is arranged at the periphery of the coherent light source, so that the heat energy generated by coherent light source 76 can be dissipated in a timely manner, and the service life of coherent light source 76 can be effectively prolonged.

Figure 3:
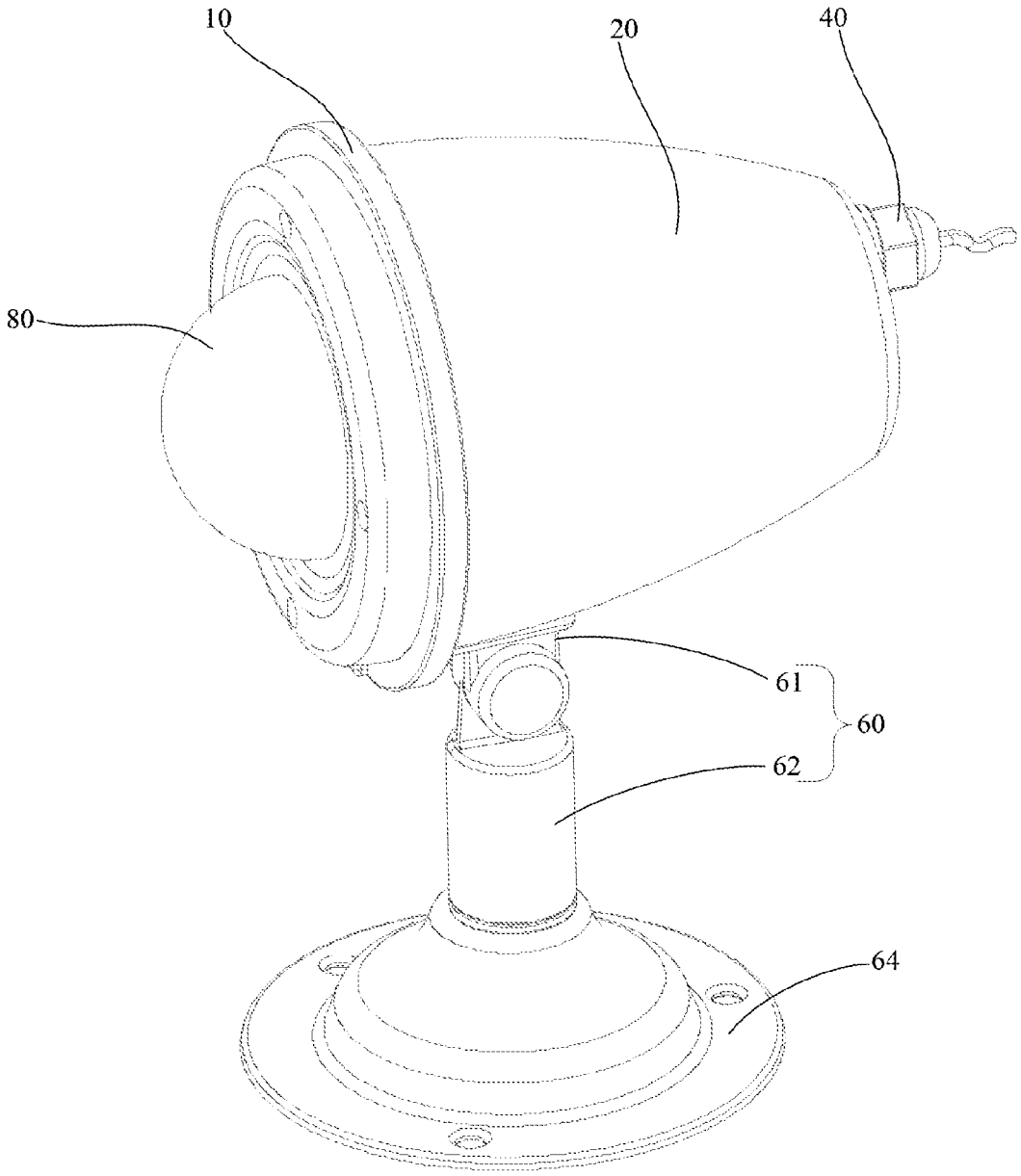
FIG. 3 is a schematic view of the overall structure of an embodiment of a light projector of the present invention.

Further, as shown in FIGS. 1 to 3, the housing includes a front housing 10 and a rear housing 20 snap-fitted with the front housing 10, a first sealing ring 30 is arranged at the joint of the front housing 10 and the rear housing 20, the mounting hole is provided in the front housing 10, and the rear housing 20 is provided with a first line passage hole 21 for allowing a power line to pass through. In this embodiment, the housing may be divided into a front housing 10 and a rear housing 20, or may be divided into an upper housing and a lower housing. Since the optical lens 80 needs to be arranged at the front end of the housing, it is not convenient to mount the optical lens 80 and other components of the light projector if the housing is divided into an upper housing and a lower housing. Therefore, it is preferable to divide the housing into a front housing 10 and a rear housing 20 to facilitate the installation of the other components of the light projector. The rear housing 20 is provided with the first line passage hole 21 for allowing the power line to pass through, so as to supply power to the drive device 90 and the light sources.

Further, the first sealing ring 30 is arranged at the joint of the front housing 10 and the rear housing 20, and is used for improving the sealing performance of the housing, so that when the light projector is arranged outdoors, the use of the light projector will not be affected even in rainy weather, thereby effectively improving the practicability of the light projector.

Further, the light projector further includes a seal 40. The rear housing 20 is recessed to form a sealing groove 22, the first line passage hole 21 is provided in a groove bottom of the sealing groove 22, a groove wall of the sealing groove 22 is provided with an internal thread, the seal 40 is in threaded connection with the sealing groove 22, and the seal 40 is further provided with a second line passage hole 41 for allowing the power line to pass through. In this embodiment, the seal 40 is used for improving the sealing performance of the first line passage hole 21 to prevent rainwater, dust and other substances from entering the housing through the first line passage hole 21. The seal 40 is a hexagonal screw head. In order to adapt to the seal 40, the rear housing 20 is formed with the sealing groove 22, and the groove wall of the sealing groove 22 is provided with an internal thread, so that the seal 40 is in threaded connection with the sealing groove 22. The threaded connection can effectively increase the sealing performance of the housing and improve the waterproof effect, and further increase the application scenarios of the light projector. Moreover, the seal 40 is further provided with a second line passage hole 41, and the first line passage hole 21 is in communication with the second line passage hole 41 for allowing the power line to pass through.

Further, a second sealing ring 50 is further arranged between the seal 40 and the groove bottom of the sealing groove 22. The second sealing ring 50 is used for further improving the sealing performance of the housing and the waterproof effect of the housing.

Further, the support mechanism includes a sleeve 60 rotatably arranged on the housing and a ground stake 63 with one end inserted into the sleeve 60. In this embodiment, the ground stake 63 serves as a component that is inserted into the ground for fixing the light projector when placed outdoors, and is detachably connected to the sleeve 60 to facilitate storage. The sleeve 60 includes a connection member 61 and a sleeve body 62. One end of the connection member 61 is detachably connected to the housing and the other end thereof is rotatably connected to the sleeve body 62, such that the housing can rotate relative to the sleeve body 62, and the projection angle of the light projector can thus be adjusted, so that the light projector can adapt to more installation scenes.

In another embodiment, the support mechanism may further include a sleeve 60 and a mount base 64 with one end inserted into the sleeve 60 and the other end fixed to the ground, facilitating the indoor fixation and use of the light projector.

Only optional embodiments of the present invention are described above, and do not limit the patent scope of the present invention. Under the inventive concept of the present invention, any equivalent structural transformation that is made by using the contents of the description and the accompanying drawings of the present invention or directly/indirectly applied in other related technical fields is included in the scope of protection of the present invention.

The invention claimed is:

1. A light projector, comprising: a housing, a support mechanism, an optical lens, a light-emitting assembly, and a drive device, wherein a front end of the housing is provided with a mounting hole, the optical lens is arranged in the mounting hole, and the support mechanism is arranged at a lower part of the housing for supporting the housing;

the light-emitting assembly and the drive device are arranged in the housing; the light-emitting assembly comprises a water ripple optic, a control board, at least one incoherent light source, and at least one coherent light source; one side of the water ripple optic is arranged facing the optical lens, and the control board is arranged on the other side of the water ripple optic; the control board is provided with a first through-hole and a second through-hole; the first through-hole is substantially provided at a center of the control board; and the second through-hole is off-center from the first through-hole; the drive device passes through the first through-hole and is connected to the water ripple optic to drive the water ripple optic to rotate; and the coherent light source is arranged in the second through-hole, and the incoherent light source is arranged on one side of the control board facing the water ripple optic; wherein one face of the water ripple optic that is arranged facing the optical lens is shaped to simulate irregular and uneven water ripples;

wherein the light-emitting assembly further comprises a cover, and a fixing ring for fixing the coherent light source is arranged on the cover.

2. The light projector of claim 1, wherein the cover is provided over the incoherent light source and the coherent light source and is fixed to the control board.

3. The light projector of claim 1, wherein the light-emitting assembly further comprises a heat sink arranged on a periphery of the coherent light source.

4. The light projector of claim 1, wherein the optical lens is in a semi-spherical shape, an outer spherical surface of the optical lens is a smooth surface without texture, and an inner spherical surface of the optical lens is composed of a plurality of polyhedral pyramid prisms connected to each other.

5. The light projector of claim 1, wherein the housing comprises a front housing and a rear housing snap-fitted with the front housing, a first sealing ring is arranged at the joint of the front housing and the rear housing, the mounting hole is provided in the front housing, and the rear housing is provided with a first line passage hole for allowing a power line to pass through.

6. The light projector of claim 5, further comprising a seal, wherein the rear housing is recessed to form a sealing groove, the first line passage hole is provided in a groove bottom of the sealing groove, a groove wall of the sealing groove is provided with an internal thread, the seal is in threaded connection with the sealing groove, and the seal is further provided with a second line passage hole for allowing the power line to pass through.

7. The light projector of claim 6, wherein a second sealing ring is arranged between the seal and the groove bottom of the sealing groove.

8. The light projector of claim 1, wherein the support mechanism comprises a sleeve rotatably arranged on the housing and a ground stake with one end inserted into the sleeve.

9. The light projector of claim 1, wherein the support mechanism comprises a sleeve rotatably arranged on the housing and a mount base with one end inserted into the sleeve and the other end fixed to the ground.

* * * * *